US010719834B2

(12) United States Patent
Faro et al.

(10) Patent No.: US 10,719,834 B2
(45) Date of Patent: Jul. 21, 2020

(54) SYSTEMS AND METHODS FOR RECOMMENDING MERCHANTS

(75) Inventors: Walter Lo Faro, Chesterfield, MO (US); Christopher J. Merz, Wildwood, MO (US)

(73) Assignee: MASTERCARD INTERNATIONAL INCORPORATED, Purchase, NY (US)

( * ) Notice: Subject to any disclaimer, the term of this patent is extended or adjusted under 35 U.S.C. 154(b) by 269 days.

(21) Appl. No.: 13/112,744

(22) Filed: May 20, 2011

(65) Prior Publication Data

US 2012/0296724 A1 Nov. 22, 2012

(51) Int. Cl.
*G06Q 30/00* (2012.01)

(52) U.S. Cl.
CPC ..... *G06Q 30/00* (2013.01)

(58) Field of Classification Search
USPC ..... 705/14.4, 14.44, 14.49, 14.51, 14.53, 705/14.58, 10, 26
See application file for complete search history.

(56) References Cited

U.S. PATENT DOCUMENTS 6,505,168 B1 1/2003 Rothman et al.
6,782,370 B1 8/2004 Stack
7,181,438 B1 2/2007 Szabo
7,546,254 B2 6/2009 Bednarek
7,792,697 B2 9/2010 Bhagchandani et al.
8,190,478 B2 * 5/2012 Herman ..... G06Q 30/02 705/14.49
2002/0161664 A1 10/2002 Shaya et al.
2003/0037041 A1 2/2003 Hertz
2003/0216960 A1 11/2003 Postrel
2005/0251440 A1 * 11/2005 Bednarek ..... 705/10
2006/0259364 A1 11/2006 Strock et al.
2007/0038515 A1 2/2007 Postrel
(Continued)

OTHER PUBLICATIONS

Search Report and Written Opinion dated Aug. 3, 2012, PCT Application No. PCT/US 2012/038515 (12 pages).
(Continued)

*Primary Examiner* — Afaf Osman Bilal Ahmed
(74) *Attorney, Agent, or Firm* — Armstrong Teasdale LLP

(57) ABSTRACT

A method and a recommender computer system are provided. The recommender computer system is programmed to receive payment card transaction information for a payment cardholder from the interchange network. The payment card transaction information includes data relating to a plurality of purchases made by the cardholder at a plurality of different merchants. The recommender computer system is further programmed to receive merchant rating information, receive merchant descriptive information, and determine location information of each of the plurality of different merchants relative to at least one of a predetermined selectable location and a current location of the cardholder. The recommender computer system then determines a relative ranking of the plurality of different merchants using the received payment card transaction information, the received merchant rating information, the received merchant descriptive information, and the determined location information and displays the determined recommendations to a cardholder.

21 Claims, 8 Drawing Sheets

(56) References Cited

U.S. PATENT DOCUMENTS

| | | | | |
|---|---|---|---|---|
| 2007/0244741 | A1 | 10/2007 | Blume et al. | |
| 2009/0063304 | A1* | 3/2009 | Meggs | G06Q 10/06 705/26.62 |
| 2009/0254463 | A1 | 10/2009 | Tomchek et al. | |
| 2009/0254971 | A1 | 10/2009 | Herz et al. | |
| 2009/0271246 | A1 | 10/2009 | Alvarez et al. | |
| 2009/0307060 | A1 | 12/2009 | Merz et al. | |
| 2010/0023374 | A1* | 1/2010 | Berwitz | G06Q 30/02 705/14.4 |
| 2010/0211458 | A1 | 8/2010 | Ramer et al. | |
| 2010/0256982 | A1 | 10/2010 | Bhagchandani et al. | |
| 2010/0301114 | A1 | 12/2010 | Lo Faro et al. | |
| 2010/0312724 | A1 | 12/2010 | Pinckney et al. | |
| 2011/0035279 | A1 | 2/2011 | Herman et al. | |
| 2011/0068170 | A1 | 3/2011 | Lehman | |
| 2011/0078010 | A1* | 3/2011 | Postrel | G06Q 20/105 705/14.25 |
| 2011/0078021 | A1 | 3/2011 | Tullis | |
| 2011/0093324 | A1 | 4/2011 | Fordyce, III et al. | |
| 2012/0271717 | A1* | 10/2012 | Postrel | 705/14.58 |
| 2013/0132283 | A1* | 5/2013 | Hayhow et al. | 705/67 |

OTHER PUBLICATIONS

Wikipedia: 11 Interbank network, Internet Article, Feb. 16, 2011 (Feb. 16, 2011), XP055135992, Retrieved from the Internet: URL:http://en.wikipedia.org/w/index.php?title=Interbank network&oldid=414221461 [retrieved on Aug. 22, 2014].

An Extended EP Search Report, dated Sep. 12, 2014, for co-pending EP patent application No. EP 12789273.5 (9 pgs).

Wikipedia , Location-based service, Internet Article, May 16, 2011 (May 16, 2011), XP055187300 Retrieved from the Internet: URL:http://en.wikipedia.org/w/index.php?title=Location-bsed_service&oldid=429423127 [retrieved on May 4, 2015].

International Search Report, Application No. 12789273.5-1958, dated May 8, 2015, pp. 9.

* cited by examiner

SYSTEMS AND METHODS FOR RECOMMENDING MERCHANTS

BACKGROUND OF THE INVENTION

The field of the invention relates generally to methods and systems for recommending merchants and, more particularly, to network-based methods and systems for recommending merchants to a transaction payment card holder using past transaction history of the cardholder with merchants, current preferences of the cardholder, and the transaction history of other cardholders with merchants.

Consumers today have an increasing number of entertainment choices available to them both in the number of choices segments of entertainment available, but also in the number of merchants available in each segment. As used herein, a segment is a group of merchants offering a similar entertainment experience. Such segments may include a dining segment, an events segment, a night club segment, or an activities segment. Additionally, new merchants become available, which may provide consumers an entertainment experience they would enjoy if they knew about the new merchant. Moreover, merchants may want to aid a consumer's decision by offering incentives, such as reward points, discounts, and special offers to consumers. Consumers have the option of searching numerous websites or "friending" numerous merchants in an effort to make more informed entertainment decisions. However, the websites are often not objective and their reputations are often not objective, and friending numerous merchant results in time-consuming searching through the friended merchants website.

BRIEF DESCRIPTION OF THE INVENTION

In one embodiment, a recommender computer system for use with a payment card interchange network includes a memory device and a processor in communication with the memory device. The recommender computer system is programmed to receive payment card transaction information for a payment cardholder from the interchange network wherein the interchange network is configured to process payment card transactions between a merchant through a merchant bank and a cardholder through an issuer bank. The payment card transaction information includes data relating to a plurality of purchases made by the cardholder at a plurality of different merchants. The recommender computer system is further programmed to receive merchant rating information, receive merchant descriptive information, and determine location information of each of the plurality of different merchants relative to at least one of a predetermined selectable location and a current location of the cardholder. The recommender computer system then determines a relative ranking of the plurality of different merchants using the received payment card transaction information, the received merchant rating information, the received merchant descriptive information, and the determined location information and displays the determined recommendations to a cardholder.

In another embodiment, a computer-based method for recommending merchants to a cardholder using a computer device coupled to a database includes receiving payment card transaction information for a payment cardholder from the interchange network. The interchange network is configured to process payment card transactions between a merchant through a merchant bank and a cardholder through an issuer bank and the payment card transaction information includes data relating to a plurality of purchases made by the cardholder at a plurality of different merchants. The method also includes receiving merchant rating information, receiving merchant descriptive information, and determining location information of each of the plurality of different merchants relative to at least one of a predetermined selectable location and a current location of the cardholder. The method further includes determining a relative ranking of the plurality of different merchants using the received payment card transaction information, the received merchant rating information, the received merchant descriptive information, and the determined location information and displaying the determined recommendations to a cardholder In yet another embodiment, one or more non-transitory computer-readable storage media includes computer-executable instructions embodied thereon, wherein when executed by at least one processor, the computer-executable instructions cause the processor to receive payment card transaction information for a payment cardholder from the interchange network wherein the interchange network is configured to process payment card transactions between a merchant through a merchant bank and a cardholder through an issuer bank. The payment card transaction information include data relating to a plurality of purchases made by the cardholder at a plurality of different merchants. The computer-executable instructions also cause the processor to receive merchant rating information, receive merchant descriptive information, and determine location information of each of the plurality of different merchants relative to at least one of a predetermined selectable location and a current location of the cardholder. The computer-executable instructions then cause the processor to determine a relative ranking of the plurality of different merchants using the received payment card transaction information, the received merchant rating information, the received merchant descriptive information, and the determined location information and display the determined recommendations to a cardholder.

BRIEF DESCRIPTION OF THE DRAWINGS

FIG. 1 is a schematic diagram illustrating an exemplary multi-party payment card industry system for enabling ordinary payment-by-card transactions in which merchants and card issuers do not necessarily have a one-to-one relationship.

FIG. 2 is a simplified block diagram of an exemplary system including a plurality of computer devices in accordance with one example embodiment of the present invention.

FIG. 3 is an expanded block diagram of an exemplary embodiment of a server architecture of the system including the plurality of computer devices in accordance with one example embodiment of the present invention.

FIG. 4 illustrates an exemplary configuration of a client system shown in FIGS. 2 and 3.

FIG. 5 illustrates an exemplary configuration of a server system shown in FIGS. 2 and 3.

FIG. 6 is a chart illustrating an organization of recommender system 121 (shown in FIG. 2) in accordance with an exemplary embodiment of the present invention.

FIG. 7 is a screen shot of a user interface 700 that may used with an exemplary embodiment of the present invention.

FIG. 8 is a flow diagram of a computer-based method 800 for recommending merchants to a cardholder using a computer device coupled to a database.

DETAILED DESCRIPTION OF THE INVENTION

Figure 1:
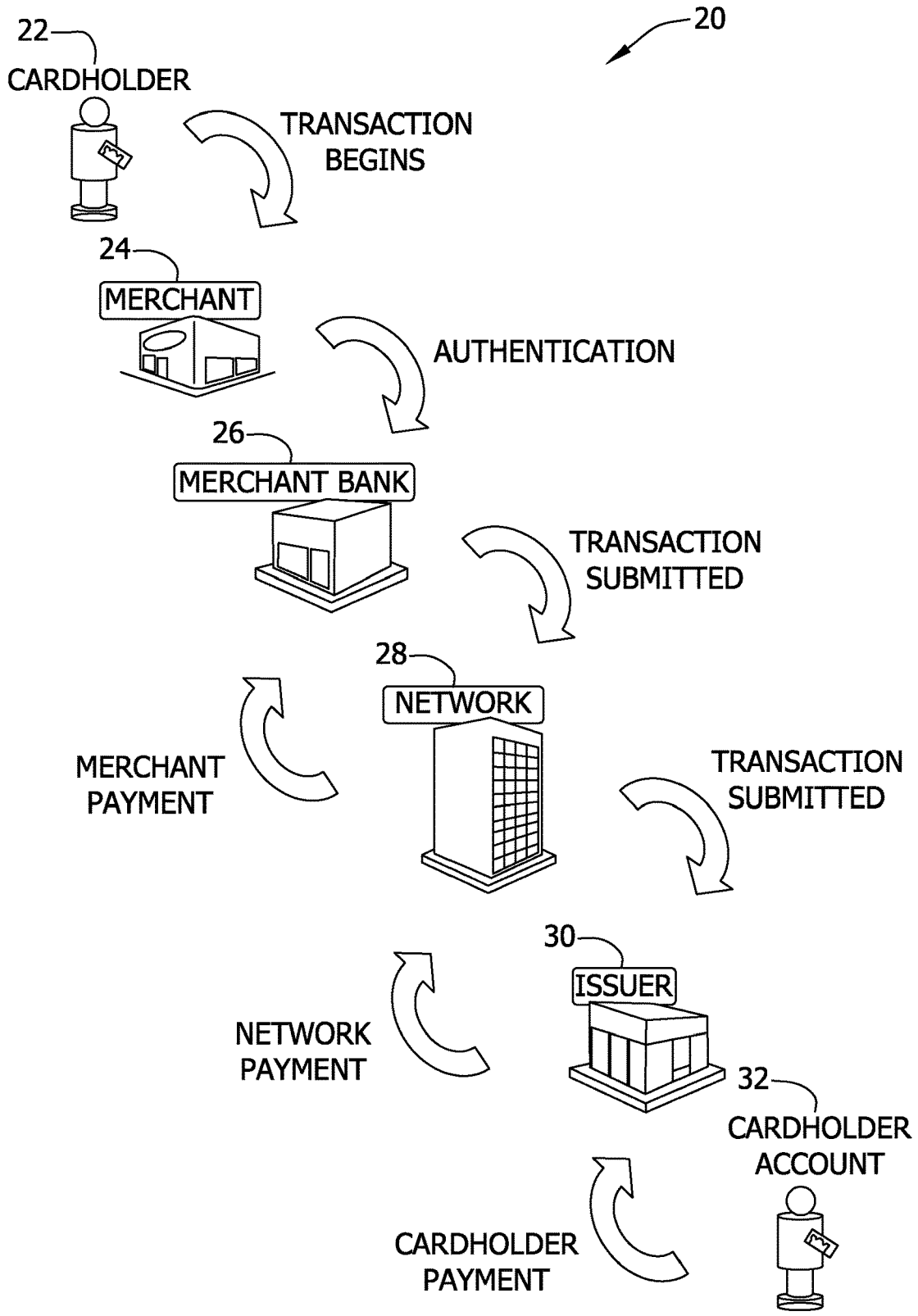
FIGS. 1-8 show exemplary embodiments of the methods and systems described herein.

Embodiments of the methods and systems described herein relate to providing payment transaction cardholders objective and reputable information for making entertainment decisions among numerous available merchants. The method includes receiving, by a recommender computer system, payment card transaction information for a payment cardholder from an interchange network wherein the interchange network configured to process payment card transactions between a merchant through a merchant bank and a cardholder through an issuer bank. The payment card transaction information typically includes at least data relating to a plurality of purchases made by the cardholder at a plurality of different merchants. The recommender computer system also receives merchant rating information and merchant descriptive information, which is used in a merchant ranking process. The recommender computer system determines location information of each of the plurality of different merchants relative to at least one of a predetermined selectable location and a current location of the cardholder using location data input by the cardholder or automatically received from, for example, a GPS unit, which may be a part of a Smartphone. The recommender computer system then determines a relative ranking of the plurality of different merchants using the received payment card transaction information, the received merchant rating information, the received merchant descriptive information, and the determined location information. A display of the determined ranked listed is provider to the cardholder via the display on a portable handheld device or other processor controlled device.

As used herein, the terms "transaction card," "financial transaction card," and "payment card" refer to any suitable transaction card, such as a credit card, a debit card, a prepaid card, a charge card, a membership card, a promotional card, a frequent flyer card, an identification card, a prepaid card, a gift card, and/or any other device that may hold payment account information, such as mobile phones, Smartphones, personal digital assistants (PDAs), key fobs, and/or computers. Each type of transactions card can be used as a method of payment for performing a transaction.

In one embodiment, a computer program is provided, and the program is embodied on a computer readable medium. In an exemplary embodiment, the system is executed on a single computer system, without requiring a connection to a sever computer. In a further exemplary embodiment, the system is being run in a Windows® environment (Windows is a registered trademark of Microsoft Corporation, Redmond, Wash.). In yet another embodiment, the system is run on a mainframe environment and a UNIX® server environment (UNIX is a registered trademark of AT&T located in New York, N.Y.). The application is flexible and designed to run in various different environments without compromising any major functionality. In some embodiments, the system includes multiple components distributed among a plurality of computing devices. One or more components may be in the form of computer-executable instructions embodied in a computer-readable medium. The systems and processes are not limited to the specific embodiments described herein. In addition, components of each system and each process can be practiced independent and separate from other components and processes described herein. Each component and process can also be used in combination with other assembly packages and processes.

The following detailed description illustrates embodiments of the invention by way of example and not by way of limitation. It is contemplated that the invention has general application to processing financial transaction data by a third party in industrial, commercial, and residential applications.

As used herein, an element or step recited in the singular and proceeded with the word "a" or "an" should be understood as not excluding plural elements or steps, unless such exclusion is explicitly recited. Furthermore, references to "example embodiment" or "one embodiment" of the present invention are not intended to be interpreted as excluding the existence of additional embodiments that also incorporate the recited features.

FIG. 1 is a schematic diagram illustrating an exemplary multi-party transaction card industry system 20 for enabling ordinary payment-by-card transactions in which merchants 24 and card issuers 30 do not need to have a one-to-one special relationship. Embodiments described herein may relate to a transaction card system, such as a credit card payment system using the MasterCard® interchange network. The MasterCard® interchange network is a set of proprietary communications standards promulgated by MasterCard International Incorporated® for the exchange of financial transaction data and the settlement of funds between financial institutions that are members of MasterCard International Incorporated®. (MasterCard is a registered trademark of MasterCard International Incorporated located in Purchase, N.Y.).

In a typical transaction card system, a financial institution called the "issuer" issues a transaction card, such as a credit card, to a consumer or cardholder 22, who uses the transaction card to tender payment for a purchase from a merchant 24. To accept payment with the transaction card, merchant 24 must normally establish an account with a financial institution that is part of the financial payment system. This financial institution is usually called the "merchant bank," the "acquiring bank," or the "acquirer." When cardholder 22 tenders payment for a purchase with a transaction card, merchant 24 requests authorization from a merchant bank 26 for the amount of the purchase. The request may be performed over the telephone, but is usually performed through the use of a point-of-sale terminal, which reads cardholder's 22 account information from a magnetic stripe, a chip, or embossed characters on the transaction card and communicates electronically with the transaction processing computers of merchant bank 26. Alternatively, merchant bank 26 may authorize a third party to perform transaction processing on its behalf. In this case, the point-of-sale terminal will be configured to communicate with the third party. Such a third party is usually called a "merchant processor," an "acquiring processor," or a "third party processor."

Using an interchange network 28, computers of merchant bank 26 or merchant processor will communicate with computers of an issuer bank 30 to determine whether cardholder's 22 account 32 is in good standing and whether the purchase is covered by cardholder's 22 available credit line. Based on these determinations, the request for authorization will be declined or accepted. If the request is accepted, an authorization code is issued to merchant 24.

When a request for authorization is accepted, the available credit line of cardholder's 22 account 32 is decreased. Normally, a charge for a payment card transaction is not posted immediately to cardholder's 22 account 32 because bankcard associations, such as MasterCard International Incorporated®, have promulgated rules that do not allow merchant 24 to charge, or "capture," a transaction until goods are shipped or services are delivered. However, with respect to at least some debit card transactions, a charge may be posted at the time of the transaction. When merchant 24 ships or delivers the goods or services, merchant 24 captures the transaction by, for example, appropriate data entry procedures on the point-of-sale terminal. This may include bundling of approved transactions daily for standard retail purchases. If cardholder 22 cancels a transaction before it is captured, a "void" is generated. If cardholder 22 returns goods after the transaction has been captured, a "credit" is generated. Interchange network 28 and/or issuer bank 30 stores the transaction card information, such as a type of merchant, amount of purchase, date of purchase, in a database 120 (shown in FIG. 2).

After a purchase has been made, a clearing process occurs to transfer additional transaction data related to the purchase among the parties to the transaction, such as merchant bank 26, interchange network 28, and issuer bank 30. More specifically, during and/or after the clearing process, additional data, such as a time of purchase, a merchant name, a type of merchant, purchase information, cardholder account information, a type of transaction, itinerary information, information regarding the purchased item and/or service, and/or other suitable information, is associated with a transaction and transmitted between parties to the transaction as transaction data, and may be stored by any of the parties to the transaction. In the exemplary embodiment, when cardholder 22 purchases travel, such as airfare, a hotel stay, and/or a rental car, at least partial itinerary information is transmitted during the clearance process as transaction data. When interchange network 28 receives the itinerary information, interchange network 28 routes the itinerary information to database 120.

After a transaction is authorized and cleared, the transaction is settled among merchant 24, merchant bank 26, and issuer bank 30. Settlement refers to the transfer of financial data or funds among merchant's 24 account, merchant bank 26, and issuer bank 30 related to the transaction. Usually, transactions are captured and accumulated into a "batch," which is settled as a group. More specifically, a transaction is typically settled between issuer bank 30 and interchange network 28, and then between interchange network 28 and merchant bank 26, and then between merchant bank 26 and merchant 24.

Figure 2:
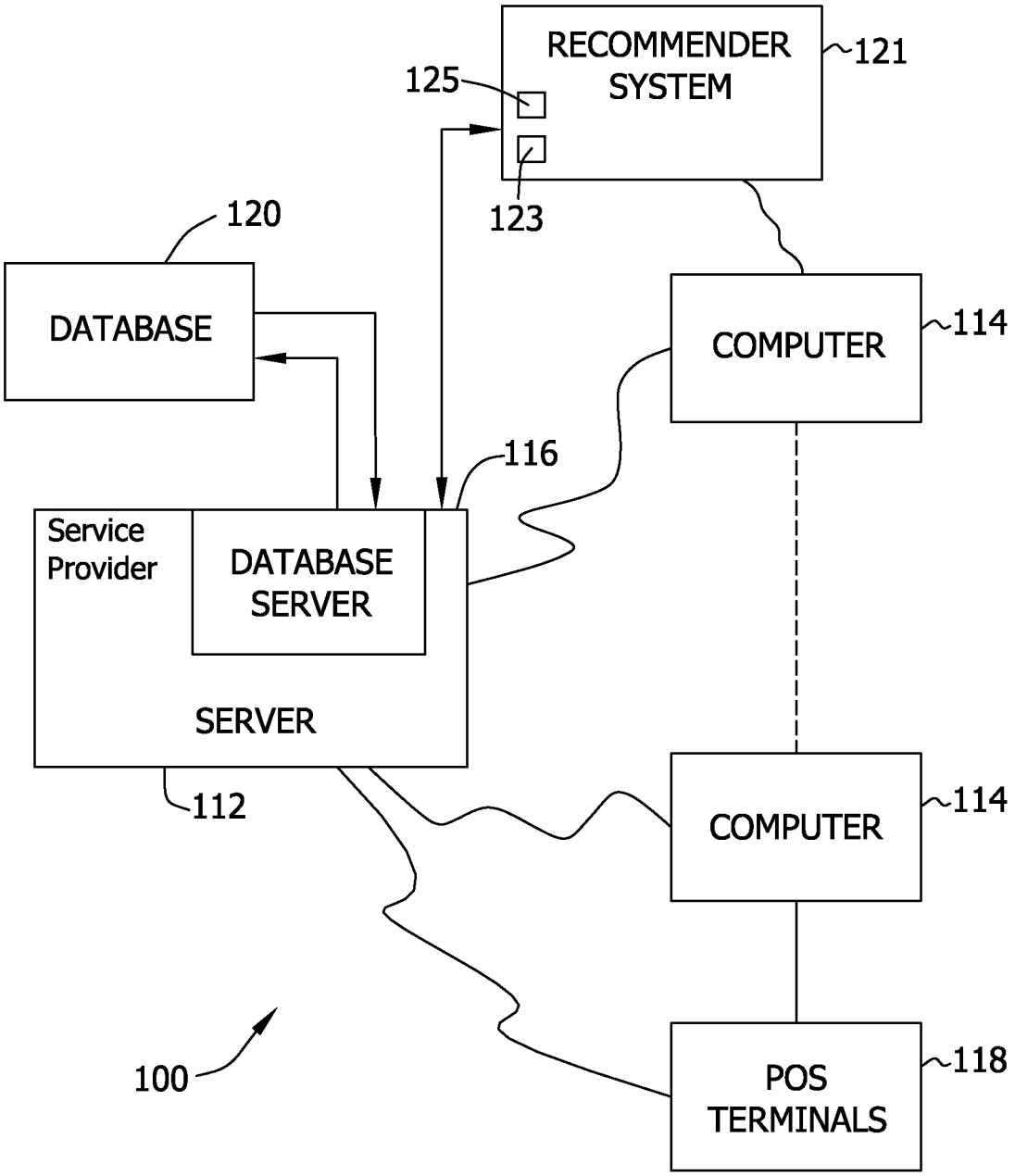

FIG. 2 is a simplified block diagram of an exemplary processing system 100 including a plurality of computer devices in accordance with one embodiment of the present invention. In the example embodiment, system 100 may be used for performing payment-by-card transactions received as of part processing the financial transaction.

More specifically, in the example embodiment, system 100 includes a server system 112, and a plurality of client sub-systems, also referred to as client systems 114, connected to server system 112. In one embodiment, client systems 114 are computers including a web browser, such that server system 112 is accessible to client systems 114 using the Internet. Client systems 114 are interconnected to the Internet through many interfaces including a network, such as a local area network (LAN) or a wide area network (WAN), dial-in-connections, cable modems, and special high-speed Integrated Services Digital Network (ISDN) lines. Client systems 114 could be any device capable of interconnecting to the Internet including a web-based phone, PDA, or other web-based connectable equipment.

System 100 also includes point-of-sale (POS) terminals 118, which may be connected to client systems 114 and may be connected to server system 112. POS terminals 118 are interconnected to the Internet through many interfaces including a network, such as a local area network (LAN) or a wide area network (WAN), dial-in-connections, cable modems, wireless modems, and special high-speed ISDN lines. POS terminals 118 could be any device capable of interconnecting to the Internet and including an input device capable of reading information from a consumer's financial transaction card.

A database server 116 is connected to database 120, which contains information on a variety of matters, as described below in greater detail. In one embodiment, centralized database 120 is stored on server system 112 and can be accessed by potential users at one of client systems 114 by logging onto server system 112 through one of client systems 114. In an alternative embodiment, database 120 is stored remotely from server system 112 and may be non-centralized.

Database 120 may include a single database having separated sections or partitions or may include multiple databases, each being separate from each other. Database 120 may store transaction data generated as part of sales activities conducted over the processing network including data relating to merchants, account holders or customers, issuers, acquirers, purchases made. Database 120 may also store account data including at least one of a cardholder name, a cardholder address, an account number, and other account identifier. Database 120 may also store merchant data including a merchant identifier that identifies each merchant registered to use the network, and instructions for settling transactions including merchant bank account information. Database 120 may also store purchase data associated with items being purchased by a cardholder from a merchant, and authorization request data.

In the example embodiment, one of client systems 114 may be associated with acquirer bank 26 (shown in FIG. 1) while another one of client systems 114 may be associated with issuer bank 30 (shown in FIG. 1). POS terminal 118 may be associated with a participating merchant 24 (shown in FIG. 1) or may be a computer system and/or mobile system used by a cardholder making an on-line purchase or payment. Server system 112 may be associated with interchange network 28. In the exemplary embodiment, server system 112 is associated with a network interchange, such as interchange network 28, and may be referred to as an interchange computer system. Server system 112 may be used for processing transaction data. In addition, client systems 114 and/or POS 118 may include a computer system associated with at least one of an online bank, a bill payment outsourcer, an acquirer bank, an acquirer processor, an issuer bank associated with a transaction card, an issuer processor, a remote payment system, and/or a biller. Further, a recommender system 121 may be included in client systems 114 or optionally may be included in server system 112. In various embodiments, recommender system 121 may be associated with a standalone processor or may be associated with a separate third party provider in a contractual relationship with interchange network 28 and configured to perform the functions described herein. Accordingly, each party involved in processing transaction data are associated with a computer system shown in system 100 such that the parties can communicate with one another as described herein.

Using the interchange network, the computers of the merchant bank or the merchant processor will communicate with the computers of the issuer bank to determine whether the consumer's account is in good standing and whether the purchase is covered by the consumer's available credit line. Based on these determinations, the request for authorization will be declined or accepted. If the request is accepted, an authorization code is issued to the merchant.

When a request for authorization is accepted, the available credit line of consumer's account is decreased. Normally, a charge is not posted immediately to a consumer's account because bankcard associations, such as MasterCard International Incorporated®, have promulgated rules that do not allow a merchant to charge, or "capture," a transaction until goods are shipped or services are delivered. When a merchant ships or delivers the goods or services, the merchant captures the transaction by, for example, appropriate data entry procedures on the point-of-sale terminal. If a consumer cancels a transaction before it is captured, a "void" is generated. If a consumer returns goods after the transaction has been captured, a "credit" is generated.

For debit card transactions, when a request for a PIN authorization is approved by the issuer, the consumer's account is decreased. Normally, a charge is posted immediately to a consumer's account. The bankcard association then transmits the approval to the acquiring processor for distribution of goods/services, or information or cash in the case of an ATM.

After a transaction is captured, the transaction is settled between the merchant, the merchant bank, and the issuer. Settlement refers to the transfer of financial data or funds between the merchant's account, the merchant bank, and the issuer related to the transaction. Usually, transactions are captured and accumulated into a "batch," which is settled as a group.

The financial transaction cards or payment cards discussed herein may include credit cards, debit cards, a charge card, a membership card, a promotional card, prepaid cards, and gift cards. These cards can all be used as a method of payment for performing a transaction. As described herein, the term "financial transaction card" or "payment card" includes cards such as credit cards, debit cards, and prepaid cards, but also includes any other devices that may hold payment account information, such as mobile phones, personal digital assistants (PDAs), key fobs, or other devices, etc.

Figure 3:
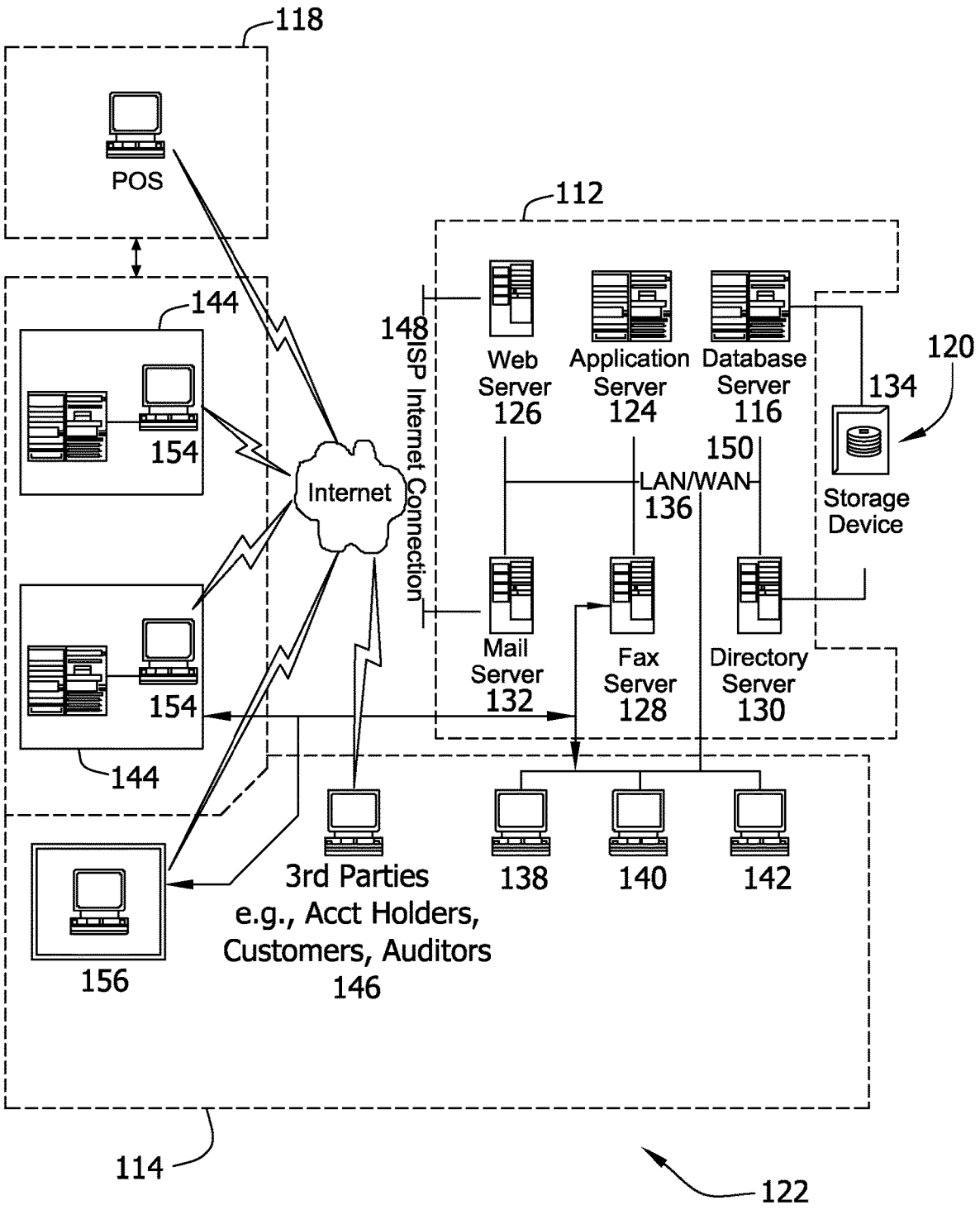

FIG. 3 is an expanded block diagram of an exemplary embodiment of a server architecture of a processing system 122 including other computer devices in accordance with one embodiment of the present invention. Components in system 122, identical to components of system 100 (shown in FIG. 2), are identified in FIG. 3 using the same reference numerals as used in FIG. 2. System 122 includes server system 112, client systems 114, and POS terminals 118. Server system 112 further includes database server 116, a transaction server 124, a web server 126, a fax server 128, a directory server 130, and a mail server 132. A storage device 134 is coupled to database server 116 and directory server 130. Servers 116, 124, 126, 128, 130, and 132 are coupled in a local area network (LAN) 136. In addition, a system administrator's workstation 138, a user workstation 140, and a supervisor's workstation 142 are coupled to LAN 136. Alternatively, workstations 138, 140, and 142 are coupled to LAN 136 using an Internet link or are connected through an Intranet.

Each workstation, 138, 140, and 142 is a personal computer having a web browser. Although the functions performed at the workstations typically are illustrated as being performed at respective workstations 138, 140, and 142, such functions can be performed at one of many personal computers coupled to LAN 136. Workstations 138, 140, and 142 are illustrated as being associated with separate functions only to facilitate an understanding of the different types of functions that can be performed by individuals having access to LAN 136.

Server system 112 is configured to be communicatively coupled to various individuals, including employees 144 and to third parties, e.g., account holders, customers, auditors, developers, consumers, merchants, acquirers, issuers, etc., 146 using an ISP Internet connection 148. The communication in the exemplary embodiment is illustrated as being performed using the Internet, however, any other wide area network (WAN) type communication can be utilized in other embodiments, i.e., the systems and processes are not limited to being practiced using the Internet. In addition, and rather than WAN 150, local area network 136 could be used in place of WAN 150.

In the exemplary embodiment, any authorized individual having a workstation 154 can access system 122. At least one of the client systems includes a manager workstation 156 located at a remote location. Workstations 154 and 156 are personal computers having a web browser. Also, workstations 154 and 156 are configured to communicate with server system 112. Furthermore, fax server 128 communicates with remotely located client systems, including a client system 156 using a telephone link. Fax server 128 is configured to communicate with other client systems 138, 140, and 142 as well.

Figure 4:
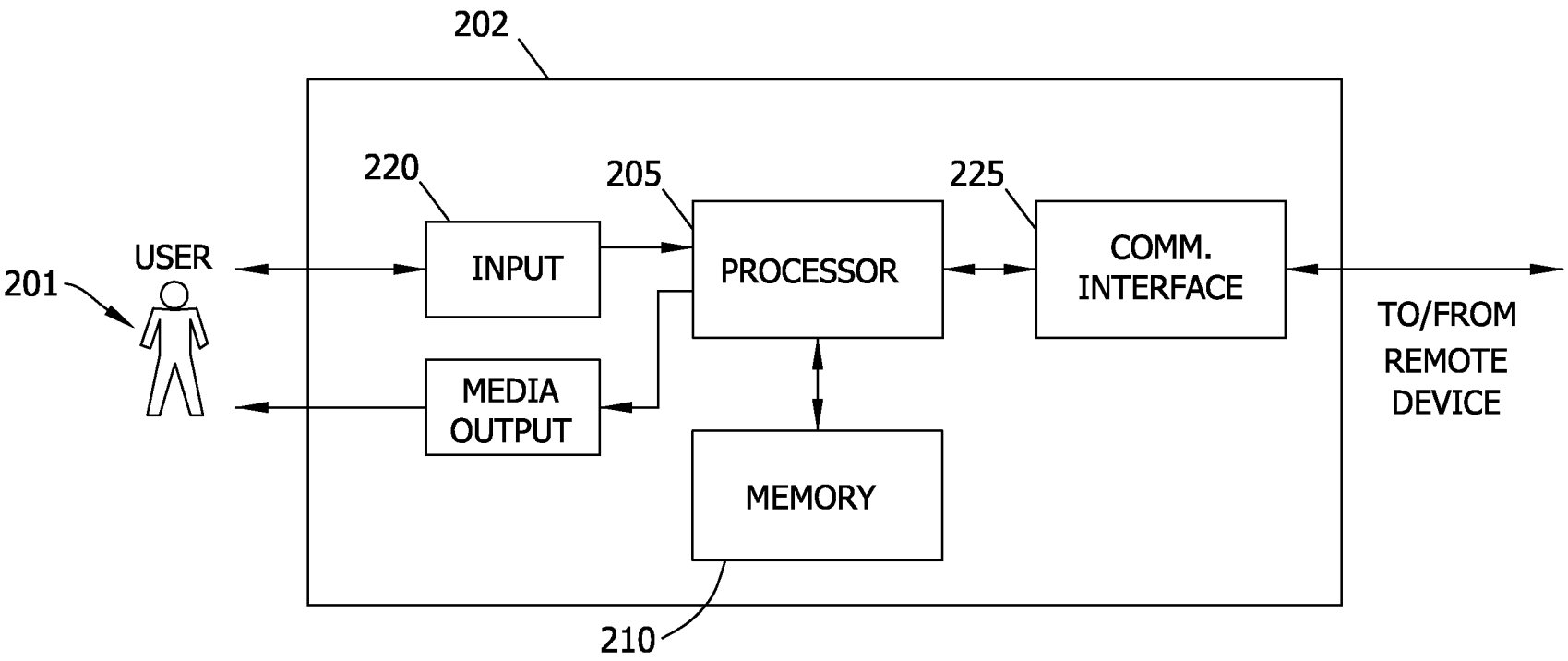

FIG. 4 illustrates an exemplary configuration of a user system 202 operated by a user 201, such as cardholder 22 (shown in FIG. 1). User system 202 may include, but is not limited to, client systems 114, 138, 140, and 142, POS terminal 118, workstation 154, and manager workstation 156. In the exemplary embodiment, user system 202 includes a processor 205 for executing instructions. In some embodiments, executable instructions are stored in a memory area 210. Processor 205 may include one or more processing units, for example, a multi-core configuration. Memory area 210 is any device allowing information such as executable instructions and/or written works to be stored and retrieved. Memory area 210 may include one or more computer readable media.

User system 202 also includes at least one media output component 215 for presenting information to user 201. Media output component 215 is any component capable of conveying information to user 201. In some embodiments, media output component 215 includes an output adapter such as a video adapter and/or an audio adapter. An output adapter is operatively coupled to processor 205 and operatively couplable to an output device such as a display device, a liquid crystal display (LCD), organic light emitting diode (OLED) display, or "electronic ink" display, or an audio output device, a speaker or headphones.

In some embodiments, user system 202 includes an input device 220 for receiving input from user 201. Input device 220 may include, for example, a keyboard, a pointing device, a mouse, a stylus, a touch sensitive panel, a touch pad, a touch screen, a gyroscope, an accelerometer, a position detector, or an audio input device. A single component such as a touch screen may function as both an output device of media output component 215 and input device 220. User system 202 may also include a communication interface 225, which is communicatively couplable to a remote device such as server system 112. Communication interface 225 may include, for example, a wired or wireless network adapter or a wireless data transceiver for use with a mobile phone network, Global System for Mobile communications (GSM), 3G, or other mobile data network or Worldwide Interoperability for Microwave Access (WIMAX).

Stored in memory area 210 are, for example, computer readable instructions for providing a user interface to user 201 via media output component 215 and, optionally, receiving and processing input from input device 220. A user interface may include, among other possibilities, a web browser and client application. Web browsers enable users, such as user 201, to display and interact with media and other information typically embedded on a web page or a website from server system 112. A client application allows user 201 to interact with a server application from server system 112.

Figure 5:
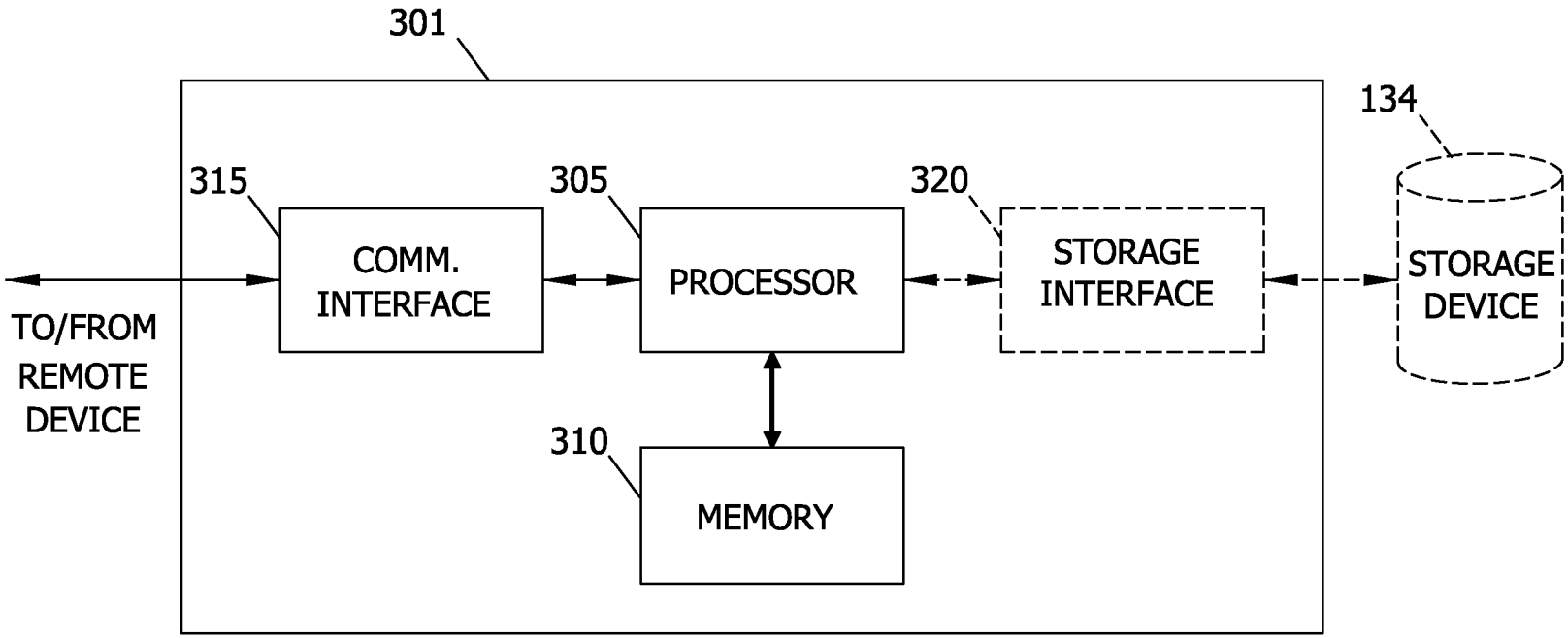

FIG. 5 illustrates an exemplary configuration of a server system 301 such as server system 112 (shown in FIGS. 2 and 3). Server system 301 may include, but is not limited to, database server 116, transaction server 124, web server 126, fax server 128, directory server 130, and mail server 132.

Server system 301 includes a processor 305 for executing instructions. Instructions may be stored in a memory area 310, for example. Processor 305 may include one or more processing units (e.g., in a multi-core configuration) for executing instructions. The instructions may be executed within a variety of different operating systems on the server system 301, such as UNIX, LENUX, Microsoft Windows®, etc. It should also be appreciated that upon initiation of a computer-based method, various instructions may be executed during initialization. Some operations may be required in order to perform one or more processes described herein, while other operations may be more general and/or specific to a particular programming language (e.g., C, C #, C++, Java, or other suitable programming languages, etc).

Processor 305 is operatively coupled to a communication interface 315 such that server system 301 is capable of communicating with a remote device such as a user system or another server system 301. For example, communication interface 315 may receive requests from user system 114 via the Internet, as illustrated in FIGS. 2 and 3.

Processor 305 may also be operatively coupled to a storage device 134. Storage device 134 is any computer-operated hardware suitable for storing and/or retrieving data. In some embodiments, storage device 134 is integrated in server system 301. For example, server system 301 may include one or more hard disk drives as storage device 134. In other embodiments, storage device 134 is external to server system 301 and may be accessed by a plurality of server systems 301. For example, storage device 134 may include multiple storage units such as hard disks or solid state disks in a redundant array of inexpensive disks (RAID) configuration. Storage device 134 may include a storage area network (SAN) and/or a network attached storage (NAS) system.

In some embodiments, processor 305 is operatively coupled to storage device 134 via a storage interface 320. Storage interface 320 is any component capable of providing processor 305 with access to storage device 134. Storage interface 320 may include, for example, an Advanced Technology Attachment (ATA) adapter, a Serial ATA (SATA) adapter, a Small Computer System Interface (SCSI) adapter, a RAID controller, a SAN adapter, a network adapter, and/or any component providing processor 305 with access to storage device 134.

Memory area 310 may include, but are not limited to, random access memory (RAM) such as dynamic RAM (DRAM) or static RAM (SRAM), read-only memory (ROM), erasable programmable read-only memory (EPROM), electrically erasable programmable read-only memory (EEPROM), and non-volatile RAM (NVRAM). The above memory types are exemplary only, and are thus not limiting as to the types of memory usable for storage of a computer program.

Figure 6:
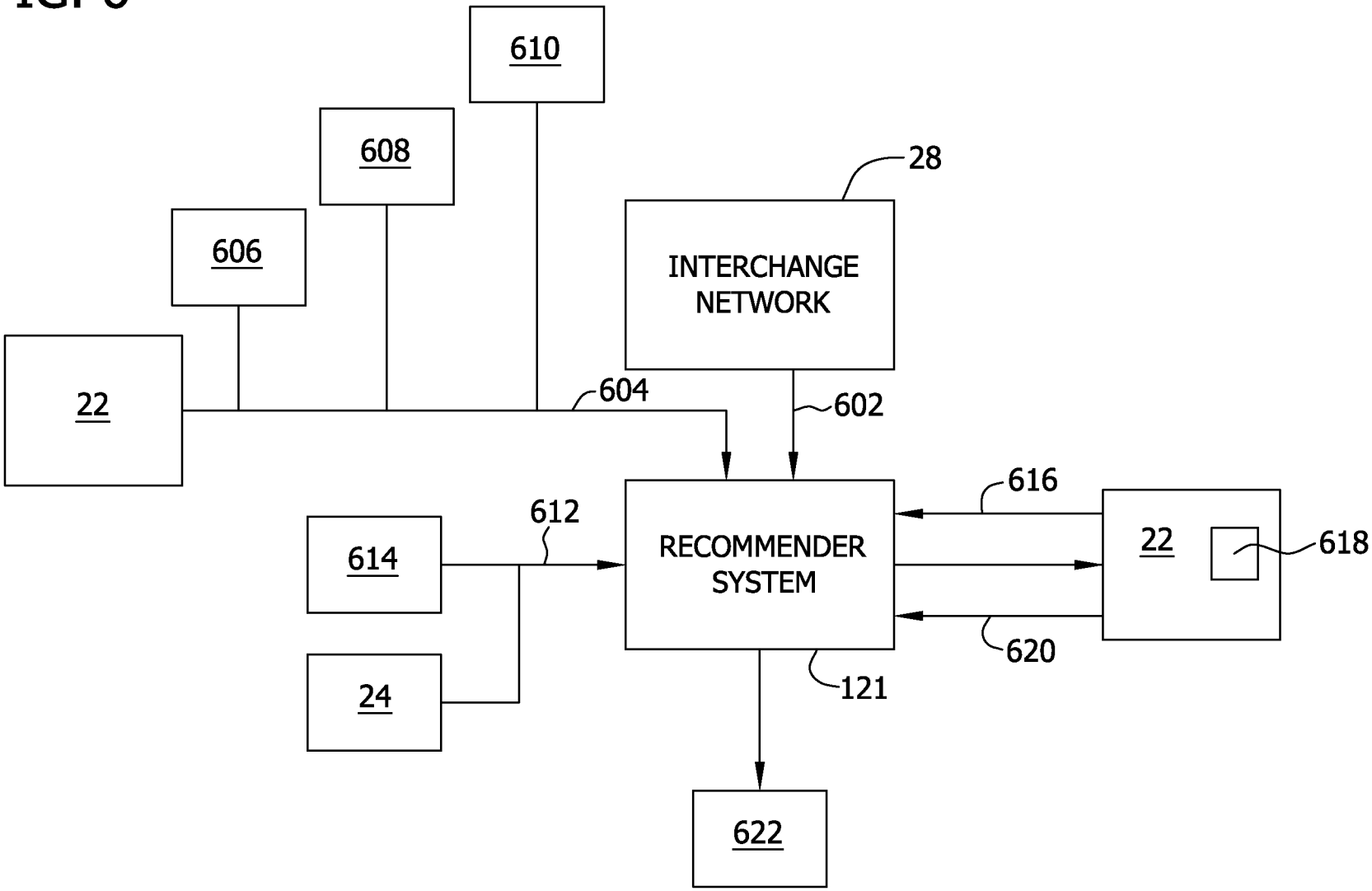

FIG. 6 is a chart illustrating an organization of recommender system 121 (shown in FIG. 2) in accordance with an exemplary embodiment of the present invention. In the exemplary embodiment, recommender system 121 is configured for use with a payment card interchange network 28 wherein recommender system 121 includes a memory device 123 and a processor 125 in communication with memory device 123. Recommender computer system 121 is programmed to receive payment card transaction information 602 for a payment cardholder from interchange network 28. Interchange network 28 is configured to process payment card transactions between merchant 24 through merchant bank 26 and cardholder 22 through issuer bank 30. Payment card transaction information 602 includes data relating to a plurality of purchases made by cardholder 22 at a plurality of different merchants 24. In various embodiments, the plurality of purchases made by the cardholder are related to each other as being in the same market segment, for example, but not limited to a dining segment, an events segment, a night club segment, or an activities segment. The dining segment may include all purchases made at restaurants and food service merchants. The events segment may include all purchases that relate to concerts, sporting, or cultural events. The night club segment may include dance clubs and casinos. The activities segment may include amusement parks, and attractions.

Recommender computer system 121 is also programmed to receive merchant rating information 604. Merchant rating information 604 may be received from a third party merchant rating service 606, a third party data aggregator 608, from cardholder 22, and/or from other cardholder customers 610 of the plurality of different merchants 24 through interchange network 28. Merchant rating information 604 may include results from surveys, Internet website scraping, solicited and unsolicited opinion data, satisfaction scale input, and/or other ranking acquisition methods. Moreover, merchant rating information 604 may relate to an overall experience with merchants 24, or may include information relating to any aspect of an experience with merchant 24.

Recommender computer system 121 is further programmed to receive merchant descriptive information 612 from merchant 24 or from a third party service 614. Merchant descriptive information 612 includes information relating to location, hours of operation, upcoming events, entertainment provided, and advertising and promotional information.

Recommender computer system 121 is also programmed to determine location information of each of the plurality of different merchants relative to at least one of a predetermined selectable location and a current location 616 of the cardholder. For example, a cardholder 22 that uses a Smartphone having a GPS capability 618 can use the determined location information to order a listing of merchants 24 by distance from a current location of cardholder 22 or a location chosen by cardholder 22, for example, a hotel in a distant city where cardholder will be staying during an upcoming trip.

In various embodiments, recommender computer system 121 is further programmed to determine a relative ranking of the plurality of different merchants using the received payment card transaction information, the received merchant rating information, the received merchant descriptive information, and the determined location information. The relative ranking provides cardholder 22 with a listing of merchant recommendations based on the previous transactions cardholder 22 has had with each merchant 24 and/or transactions other cardholders 22 have had with each merchant. Additionally, other attributes of each merchant 24 can be used in combination with the payment card transaction information to focus the results and rankings of merchants 24 to a particular situation cardholder 22 is experiencing. The results can be tailored to include whether the rankings should be for a romantic situation, a business situation, a family situation, or a friend situation. For example, if cardholder selects a romantic situation, merchants 24 that have been rated as being a romantic venue by cardholder 22 and/or other cardholders 22, by third party evaluators, and/or by the merchant itself will be ranked higher in the listing of merchant recommendations. Likewise, if cardholder 22 selects a friend situation, sports bars may be ranked relatively higher than if a family situation were selected. Moreover, a gender of cardholder 22 may also affect the listing of merchant recommendations. For example, if a female cardholder 22 selects a friend situation, sports bars may not be ranked as highly in the listing of merchant recommendations as they would for a male cardholder 22 given all other aspects of the relative ranking determination are similar.

Recommender computer system 121 is further programmed to determine a relative ranking of the plurality of different merchants 24 using an adventure input 620 received from cardholder 22. Adventure input 620 is a selection made by cardholder 22 indicating a degree to which the cardholder wishes to experience a new merchant. Often, consumers, such as cardholder 22, tend to return to merchants they are familiar with again and again. Adventure input 620 permits cardholder to indicate to recommender computer system 121 how adventurous or how much cardholder 22 would like to experience something new. If cardholder 22 indicates a low level of adventure, the listing of merchant recommendations will rank merchants 24 with a higher transaction count than merchants 24 with low or zero transaction counts, where, as used herein, a transaction count is a number of times cardholder 22 has transacted business with a particular merchant 24. If cardholder 22 indicates a high level of adventure, the listing of merchant recommendations will rank merchants 24 with a lower transaction count than merchants 24 with high transaction counts. The level of adventure input may also be used to weight the distance a merchant 24 is from cardholder's location or may affect the weight of the genre of merchant 24 or cuisine of merchant 24, if merchant 24 is a restaurant. For example, if many of cardholder's transactions are with Italian restaurants, a high level of adventure may weight That restaurants higher to assist cardholder to experience different cuisine. Adventure input 620 may be a sliding scale input, a numerical input, such as a percentage, or a textual input, such as "creature of habit" indicating a low desire for adventure or "surprise me" indicating a higher desire for adventure.

After a listing of the relative ranking of the plurality of different merchants is determined, the list is displayed to cardholder 22. In one embodiment, the listing is formatted and displayed on the cardholder's Smartphone. In various embodiments, the listing is displayed to cardholder 22 on a website 622 communicatively coupled to a network such as an intranet, WAN, or the Internet.

Recommender computer system 121 is further programmed to determine a quantity of rewards points awarded to cardholder 22 based on the received payment card transaction information wherein the quantity of rewards points is related to a combination of a transaction amount, a reward formula associated with the merchant awarding the reward points, a time of use of the payment card transaction, a rewards points tier of cardholder 22, a rewards points special sponsored by the merchant 24 awarding the reward points, and a frequency of cardholder payment card transactions with the merchant 24 awarding the reward points. Additionally, recommender computer system 121 is further programmed to recommend at least one of the plurality of different merchants 24 and merchants 24 that accept the payment card based on payment card transactions of other cardholders 22.

Figure 7:
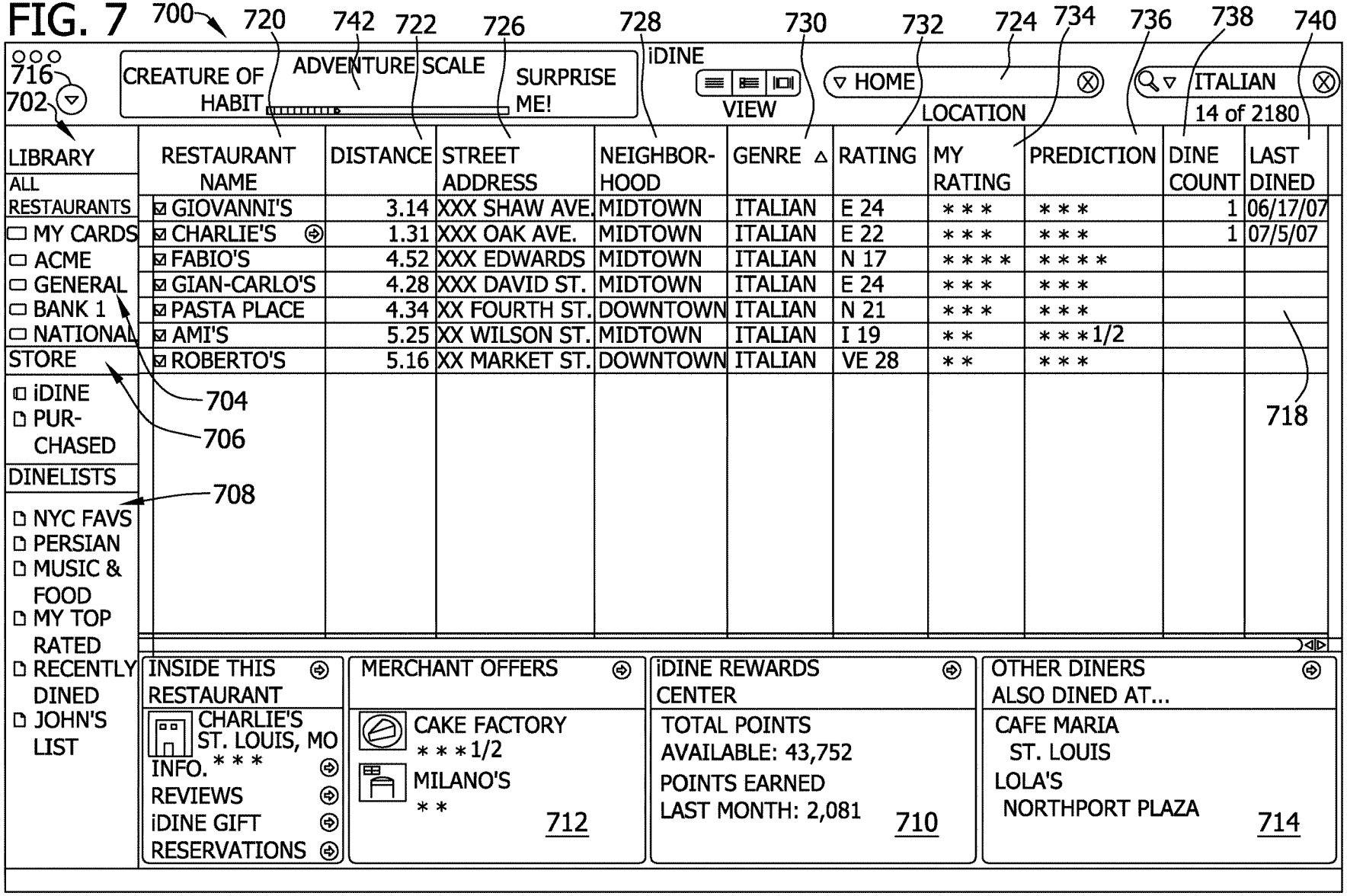

FIG. 7 is a screen shot of a user interface 700 that may used with an exemplary embodiment of the present invention. In the exemplary embodiment, user interface 700 includes a sidebar menu 702 that includes a library of major features of user interface 700. Sidebar menu 702 includes a collection of enrolled payment cards 704, a store 706 for managing rewards points that are earned and/or purchased, and a dinelist area 708 for managing lists of dining merchants. In various embodiments, dinelist area 708 may be different for managing lists related to other types of merchants.

Using the collection of enrolled payment cards 704, cardholder 22 can select information to be displayed that relates to any of cardholder's 22 enrolled payment transaction cards. Store 706 supports a rewards platform for all enrolled payment transaction cards, is used to accrue points via restaurant, hotel, or air spending, consolidate points across cards, share points with an existing platform, and buy points, for example, as a gift. A rewards center 710 is used with store 706 to display for example, a current rewards point tally and tallies of rewards points for other selectable time periods and/or sources. Dinelist area 708 permits cardholder 22 to share and/or organize cardholder's 22 favorite merchants 24 as lists.

A merchant offer window 712 permits merchants 24 to personalize offers to cardholder according to dining or purchasing history. The personalized offers may include 2 for 1 offers, discounted purchases, and offers that are combined with rewards points. An expanded recommendations window 714 makes recommendations to cardholder that are beyond the original search criteria. For example, recommender system 121 may display a listing of alternate recommended merchants 24 determined from a different criteria than the listing of recommended merchants 24. The listing of alternate recommended merchants 24 may be determined using a subset of the selectable inputs that are user to generate the listing of recommended merchants 24. Moreover, other algorithms may be used to select alternate recommended merchants 24.

A download transactions button 716 permits cardholder 22 to download transaction history for some or all enrolled cards. The desired enrolled cards are selected in from the collection of enrolled payment cards 704. When download transactions button 716 is clicked, a listing of recommended merchants 24 associated with the selected payment transaction cards is populated in the recommendations window 718. In the exemplary embodiment, recommendations window 718 includes a plurality of rows that each include current information relating to a respective merchant entry. A plurality of columns organize the current information. In the exemplary embodiment, recommendations window 718 includes a merchant name column 720, a distance column 722 that indicates a distance from the merchant named in merchant name column 720 to a location selectable by cardholder 22 using a location selection dropdown selector 724. Location selection includes a selectable list of locations from which a distance to the merchant named in merchant name column 720 is determined. For example, location selection dropdown selector 724 may include a home location, a work location, or a current location. A manually entered location may also be selected by entering an address, GPS coordinates, intersection, or other location entry method.

Recommendations window 718 further includes a street address column 726, a neighborhood column 728, a genre column 730, a rating column 732 or columns that displays third party rating organization ratings for the merchant named in merchant name column 720. Recommendations window 718 also includes a self rating column 734 and a prediction column 736 that indicates how closely the merchant named in merchant name column 720 matches the inputs cardholder 22 selected. Recommendations window 718 includes a transaction count column 738 that tallies the number of times cardholder 22 has transacted business at the merchant named in merchant name column 720 and a last transaction date column 740. The list of recommendation in recommendations window 718 is sortable by clicking on a column heading and columns may be added or removed from recommendations window 718 as preferred by cardholder 22. The order of list of recommendation in recommendations window 718 may be affected by a cardholder's selection on a adventure scale 742.

Figure 8:
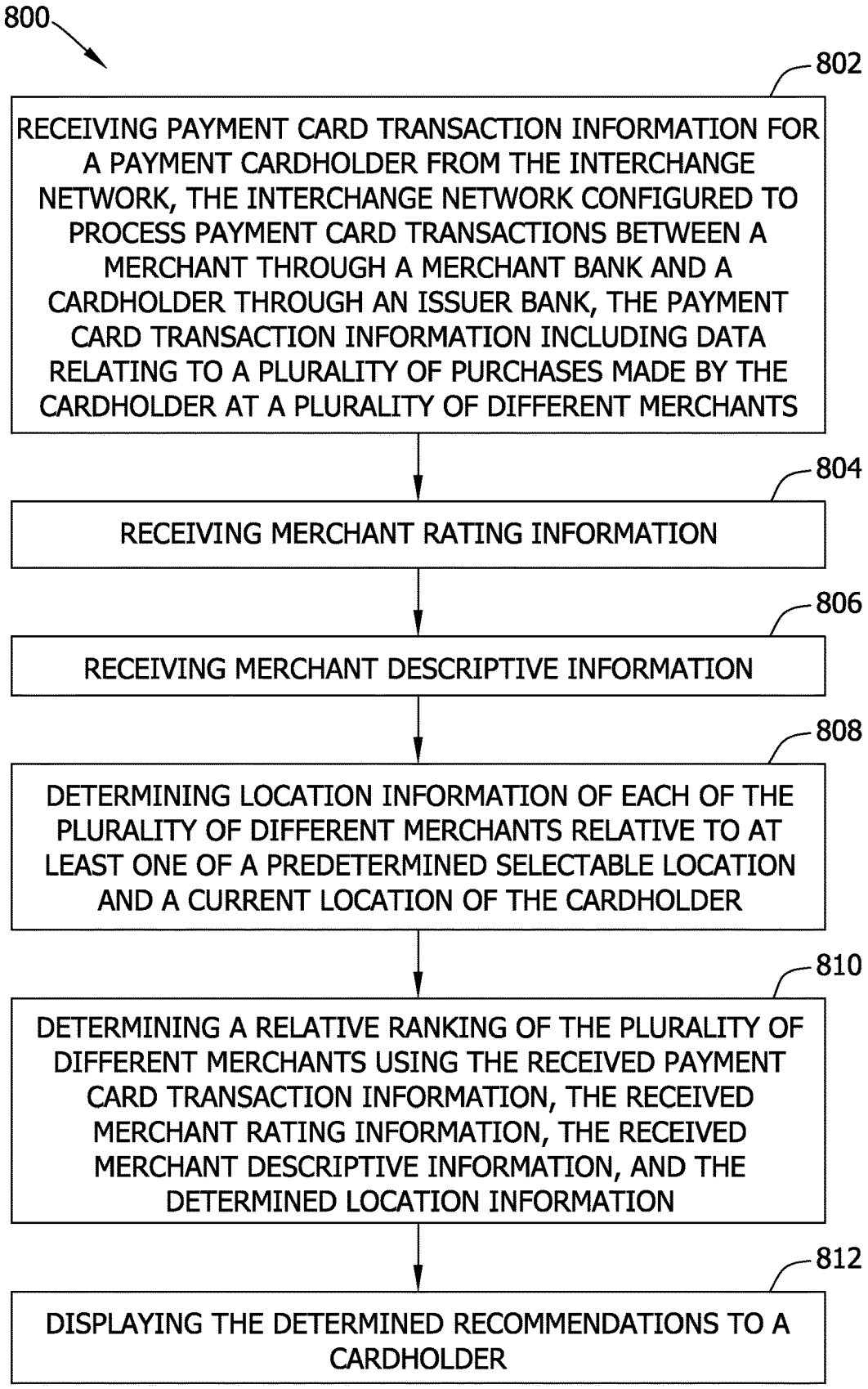

FIG. 8 is a flow diagram of a computer-based method 800 for recommending merchants to a cardholder using a computer device coupled to a database. In the exemplary embodiment, method 800 includes receiving 802 payment card transaction information for a payment cardholder from the interchange network, the interchange network configured to process payment card transactions between a merchant through a merchant bank and a cardholder through an issuer bank, the payment card transaction information including data relating to a plurality of purchases made by the cardholder at a plurality of different merchants. Method 800 also includes receiving 804 merchant rating information, receiving 806 merchant descriptive information, determining 808 location information of each of the plurality of different merchants relative to at least one of a predetermined selectable location and a current location of the cardholder, determining 810 a relative ranking of the plurality of different merchants using the received payment card transaction information, the received merchant rating information, the received merchant descriptive information, and the determined location information, and displaying 812 the determined recommendations to a cardholder.

The term processor, as used herein, refers to central processing units, microprocessors, microcontrollers, reduced instruction set circuits (RISC), application specific integrated circuits (ASIC), logic circuits, and any other circuit or processor capable of executing the functions described herein.

As used herein, the terms "software" and "firmware" are interchangeable, and include any computer program stored in memory for execution by a processor, including RAM memory, ROM memory, EPROM memory, EEPROM memory, and non-volatile RAM (NVRAM) memory. The above memory types are exemplary only, and are thus not limiting as to the types of memory usable for storage of a computer program.

As will be appreciated based on the foregoing specification, the above-described embodiments of the disclosure may be implemented using computer programming or engineering techniques including computer software, firmware, hardware or any combination or subset thereof, wherein the technical effect is receiving payment card transaction information for a payment cardholder from the interchange network wherein the payment card transaction information includes data relating to a plurality of purchases made by the cardholder at a plurality of different merchants and using the payment card transaction information, determining a relative ranking of the plurality of different merchants. The determination also being based on information regarding the cardholders' preferences and purchasing behaviors as well as the purchasing behaviors of other cardholders. Any such resulting program, having computer-readable code means, may be embodied or provided within one or more computer-readable media, thereby making a computer program product, i.e., an article of manufacture, according to the discussed embodiments of the disclosure. The computer-readable media may be, for example, but is not limited to, a fixed (hard) drive, diskette, optical disk, magnetic tape, semiconductor memory such as read-only memory (ROM), and/or any transmitting/receiving medium such as the Internet or other communication network or link. The article of manufacture containing the computer code may be made and/or used by executing the code directly from one medium, by copying the code from one medium to another medium, or by transmitting the code over a network.

The above-described embodiments of a method and system of ranking merchants according to a cardholder's preferences and purchasing behaviors provides a cost-effective and reliable means for maintaining contact with a customer by merchants and a network interchange provider. As a result, the methods and systems described herein facilitate leveraging an interchange networks' assets to engage cardholders and merchants in an enhanced purchasing experience in a cost-effective and reliable manner.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A recommender computer system for use with a payment card interchange network, said system comprising a memory device and a processor in communication with the memory device, the recommender computer system is programmed to:

receive payment card transaction information for a payment cardholder from the interchange network, the interchange network configured to process payment card transactions between a merchant through a merchant bank and a cardholder through an issuer bank, the payment card transaction information including data relating to a plurality of purchases made by the cardholder at a plurality of different merchants;

receive merchant rating information;

receive merchant descriptive information;

receive current location information of the cardholder from a GPS unit of a handheld device proximate the cardholder;

determine location information of each of the plurality of different merchants relative to at least one of a predetermined selectable location and a current location of the cardholder, the current location of the cardholder being determined from the received current location information;

determine an initial relative ranking of the plurality of different merchants using the received payment card transaction information, the received merchant rating information, the received merchant descriptive information, and the determined location information;

display initial merchant recommendations to the cardholder, on a second portion of an interactive graphical user interface of the handheld device, using the initial relative ranking;

display, on a first portion of the interactive graphical user interface of the handheld device, an adventure scale, the adventure scale including a sliding scale input control representing incremental levels of interest in experiencing a new merchant ranging from a low level of interest to a high level of interest;

receive, via user interaction with the sliding scale input control of the adventure scale displayed on the interactive graphical user interface, an adventure input indicating a selected one of the incremental levels of interest;

generate an updated relative ranking by re-ordering the initial relative ranking, including re-weighting, based on the received selected one of the incremental levels of interest, at least one of (i) a number of times the cardholder has transacted business with each of the plurality of different merchants, (ii) a distance of each of the plurality of different merchants from the cardholder's determined location information, and (iii) a number of the cardholder's transactions associated with a genre of each of the plurality of different merchants; and update the second portion of the interactive graphical user interface to display updated merchant recommendations to the cardholder, using the updated relative ranking.

2. A system in accordance with claim 1, wherein the recommender computer system is further programmed to receive merchant rating information from a third party merchant rating service.

3. A system in accordance with claim 1, wherein the recommender computer system is further programmed to receive merchant rating information from a third party data aggregator.

4. A system in accordance with claim 1, wherein the recommender computer system is further programmed to receive merchant rating information from the cardholder.

5. A system in accordance with claim 1, wherein the recommender computer system is further programmed to receive merchant rating information from other cardholder customers of the plurality of different merchants through the interchange network.

6. A system in accordance with claim 1, wherein the plurality of purchases made by the cardholder at a plurality of different merchants are related to each other as being in a same market segment.

7. A system in accordance with claim 1, wherein the recommender computer system is further programmed to receive merchant descriptive information from a respective one of the plurality of different merchants.

8. A system in accordance with claim 1, wherein the recommender computer system is further programmed to display the plurality of different merchants, on the graphical user interface of the handheld device proximate the cardholder, relative to the at least one of a predetermined selectable location and the current location of the cardholder.

9. A system in accordance with claim 1, wherein the recommender computer system is further programmed to determine a quantity of rewards points awarded to the cardholder based on the received payment card transaction information wherein the quantity of rewards points is related to a combination of a transaction amount, a reward formula associated with the merchant awarding the reward points, a time of use of the payment card transaction, a rewards points tier of the cardholder, a rewards points special sponsored by the merchant awarding the reward points, and a frequency of cardholder payment card transactions with the merchant awarding the reward points.

10. A system in accordance with claim 1, wherein the recommender computer system is further programmed to recommend at least one of the plurality of different merchants and other merchants that accept payment by payment card based on payment card transactions of other cardholders processed by the interchange network.

11. A computer-based method for recommending merchants to a cardholder using a computer device coupled to a database, the method comprising:

receiving, by the computer device, payment card transaction information for a payment cardholder from an interchange network, the interchange network configured to process payment card transactions between a merchant through a merchant bank and a cardholder through an issuer bank, the payment card transaction information including data relating to a plurality of purchases made by the cardholder at a plurality of different merchants;

receiving, by the computer device, merchant rating information from a merchant rating service;

receiving, by the computer device, merchant descriptive information from at least one of a merchant and a third party information service;

receiving, by the computer device, current location information of the cardholder from a GPS unit of a handheld device proximate the cardholder;

determining location information, by the computer device, of each of the plurality of different merchants relative to at least one of a predetermined selectable location and a current location of the cardholder, the current location of the cardholder determined from the received current location information;

determining, by the computer device, an initial relative ranking of the plurality of different merchants using the received payment card transaction information, the received merchant rating information, the received merchant descriptive information, and the determined location information;

displaying initial merchant recommendations to the cardholder, on a second portion of an interactive graphical user interface of the handheld device, using the initial relative ranking;

displaying, on a first portion of the interactive graphical user interface of the handheld device, an adventure scale, the adventure scale including a sliding scale input control representing incremental levels of interest in experiencing a new merchant ranging from a low level of interest to a high level of interest;

receiving, via user interaction with the sliding scale input control of the adventure scale displayed on the interactive graphical user interface, an adventure input indicating a selected one of the incremental levels of interest;

generating an updated relative ranking by re-ordering the initial relative ranking, including re-weighting, based on the received selected one of the incremental levels of interest, at least one of (i) a number of times the cardholder has transacted business with each of the plurality of different merchants, (ii) a distance of each of the plurality of different merchants from the cardholder's determined location information, and (iii) a number of the cardholder's transactions associated with a genre of each of the plurality of different merchants; and updating the second portion of the interactive graphical user interface to display updated merchant recommendations to the cardholder, using the updated relative ranking.

12. A method in accordance with claim 11, wherein receiving merchant rating information comprises receiving merchant rating information from at least one of a third party merchant rating service, a third party data aggregator, the cardholder; and other cardholder customers of the plurality of different merchants through the interchange network.

13. A method in accordance with claim 11, wherein receiving merchant descriptive information comprises receiving merchant descriptive information from a respective one of the plurality of different merchants.

14. A method in accordance with claim 11, further comprising displaying the plurality of different merchants, on the graphical user interface of the handheld device proximate the cardholder, relative to the at least one of a predetermined selectable location and the current location of the cardholder.

15. A method in accordance with claim 11, further comprising determining a quantity of rewards points awarded to the cardholder based on the received payment card transaction information wherein the quantity of rewards points is related to a combination of a transaction amount, a reward formula associated with the merchant awarding the reward points, a time of use of the payment card transaction, a rewards points tier of the cardholder, a rewards points special sponsored by the merchant awarding the reward points, and a frequency of cardholder payment card transactions with the merchant awarding the reward points.

16. A method in accordance with claim 11, recommending at least one of the plurality of different merchants and other merchants that accept payment by payment card based on payment card transactions of other cardholders processed by the interchange network.

17. One or more non-transitory computer-readable storage media having computer-executable instructions embodied thereon, wherein when executed by at least one processor, the computer-executable instructions cause the processor to:

receive payment card transaction information for a payment cardholder from an interchange network, the interchange network configured to process payment card transactions between a merchant through a merchant bank and a cardholder through an issuer bank, the payment card transaction information including data relating to a plurality of purchases made by the cardholder at a plurality of different merchants;

receive merchant rating information;

receive merchant descriptive information;

receive current location information of the cardholder from a GPS unit of a handheld device proximate the cardholder;

determine location information of each of the plurality of different merchants relative to at least one of a predetermined selectable location and a current location of the cardholder, the current location of the cardholder being determined from the received current location information;

determine an initial relative ranking of the plurality of different merchants using the received payment card transaction information, the received merchant rating information, the received merchant descriptive information, and the determined location information;

display initial merchant recommendations to the cardholder, on a second portion of an interactive graphical user interface of the handheld device, using the initial relative ranking;

display, on a first portion of the interactive graphical user interface of the handheld device, an adventure scale, the adventure scale including a sliding scale input control representing incremental levels of interest in experiencing a new merchant ranging from a low level of interest to a high level of interest;

receive, via user interaction with the sliding scale input control of the adventure scale displayed on the interactive graphical user interface, an adventure input indicating a selected one of the incremental levels of interest;

generate an updated relative ranking by re-ordering the initial relative ranking, including re-weighting, based on the received selected one of the incremental levels of interest, at least one of (i) a number of times the cardholder has transacted business with each of the plurality of different merchants, (ii) a distance of each of the plurality of different merchants from the cardholder's determined location information, and (iii) a number of the cardholder's transactions associated with a genre of each of the plurality of different merchants; and update the second portion of the interactive graphical user interface to display updated merchant recommendations to the cardholder, using the updated relative ranking.

18. The computer-readable storage media of claim 17, wherein the computer-executable instructions further cause the processor to determine a quantity of rewards points awarded to the cardholder based on the received payment card transaction information wherein the quantity of rewards points is related to a combination of a transaction amount, a reward formula associated with the merchant awarding the reward points, a time of use of the payment card transaction, a rewards points tier of the cardholder, a rewards points special sponsored by the merchant awarding the reward points, and a frequency of cardholder payment card transactions with the merchant awarding the reward points.

19. A system in accordance with claim 1, wherein the recommender computer system is further programmed to receive a situation of the cardholder wherein the situation includes at least one of a romantic situation, a business situation, a family situation, and a friend situation.

20. A system in accordance with claim 1, wherein the recommender computer system is further programmed to receive a market segment of purchases made by the cardholder where the market segment includes at least one of a dining segment, an events segment, a night club segment, and an activities segment.

21. A system in accordance with claim 1, wherein the adventure input indicating the level of interest to which the cardholder wishes to experience a new merchant further comprises at least one of a numerical input and a textual input.

* * * * *